US012188319B2

(12) United States Patent
Alzaki et al.

(10) Patent No.: US 12,188,319 B2
(45) Date of Patent: Jan. 7, 2025

(54) SIDETRACKING OPERATION VIA LASER CUTTING

(71) Applicant: SAUDI ARABIAN OIL COMPANY, Dhahran (SA)

(72) Inventors: Hussien A. Alzaki, Saihat (SA); Mohammad K. Aljishi, Alqatif (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 324 days.

(21) Appl. No.: 17/648,029

(22) Filed: Jan. 14, 2022

(65) Prior Publication Data

US 2023/0228163 A1 Jul. 20, 2023

(51) Int. Cl.

| | |
|---|---|
| ***E21B 29/06*** | (2006.01) |
| ***E21B 23/01*** | (2006.01) |
| ***E21B 29/02*** | (2006.01) |
| ***E21B 33/127*** | (2006.01) |

(52) U.S. Cl.

CPC ..... *E21B 29/06* (2013.01); *E21B 23/01* (2013.01); *E21B 29/02* (2013.01); *E21B 33/127* (2013.01)

(58) Field of Classification Search

CPC ..... E21B 7/061; E21B 7/046; E21B 29/06; E21B 29/02; E21B 41/0035

See application file for complete search history.

(56) References Cited

U.S. PATENT DOCUMENTS

| | | | |
|---|---|---|---|
| 8,307,900 | B2 | 11/2012 | Fynde et al. |
| 8,430,187 | B2 | 4/2013 | Hearn |
| 8,678,087 | B2 | 3/2014 | Schultz et al. |
| 8,813,844 | B2 | 8/2014 | Hopkins et al. |
| 9,492,885 | B2 | 11/2016 | Zediker et al. |
| 10,711,580 | B2 | 7/2020 | Deutch et al. |
| 10,822,879 | B2 | 11/2020 | Batarseh |

(Continued)

FOREIGN PATENT DOCUMENTS

CN 103790515 A 5/2014

OTHER PUBLICATIONS

Batarseh, Sameeh I. et al., "Laser Drilling in Extremely Hard Formation"; Proceedings of the Offshore Technology Conference Asia; Paper No. OTC-30416-MS; pp. 1-10; Oct. 27, 2020 (10 pages).

(Continued)

*Primary Examiner* — Yong-Suk (Philip) Ro
(74) *Attorney, Agent, or Firm* — Osha Bergman Watanabe & Burton LLP

(57) ABSTRACT

A method includes deploying a bottom hole assembly downhole into a wellbore lined with a casing. While the bottom hole assembly is deployed downhole, the bottom hole assembly is used to: place a guiding profile within the wellbore casing, wherein the guiding profile is structured to physically guide a downhole drill in a direction different from that of a longitudinal axis of the casing; cut a window in the casing with a laser cutter; and withdraw at least one cut portion of the casing away from the window. A related bottom hole assembly includes: a laser cutter for cutting a window in a wellbore casing; a withdrawal mechanism for withdrawing at least one cut portion of the casing away from the cut window; and a releasable guiding profile structured to physically guide a downhole drill in a direction away from the wellbore casing.

13 Claims, 9 Drawing Sheets

(56) References Cited

U.S. PATENT DOCUMENTS

| | | | | |
|---|---|---|---|---|
| 11,077,521 | B2 | 8/2021 | Montaron et al. | |
| 2003/0098152 | A1* | 5/2003 | Kennedy | E21B 7/061 175/81 |
| 2018/0272467 | A1* | 9/2018 | Montaron | B23K 26/38 |
| 2019/0226282 | A1 | 7/2019 | Potapenko et al. | |
| 2020/0408042 | A1 | 12/2020 | Faircloth et al. | |

OTHER PUBLICATIONS

Bjorndalen, N. et al., "Numerical Investigation of Laser Drilling"; Proceedings of the SPE Eastern Regional Meeting; Paper No. SPE-84844-MS; pp. 1-7; Sep. 6, 2003 (7 pages).

Bazargan, M. et al., "Feasibility of Using Laser Bit Beside of Commom Bits to Drilling Slim Holes"; Proceedings of the International Petroleum Technology Conference; Paper No. IPTC-16453-MS; pp. 1-12; Mar. 26, 2013 (12 pages).

Sinha, Pankaj et al., "Laser Drilling Research and Application: An Update"; Proceedings of the SPE/IADC Indian Drilling Technology Conference and Exhibition; Paper No. SPE-102017-MS; pp. 1-5; Oct. 16, 2006 (5 pages).

* cited by examiner

SIDETRACKING OPERATION VIA LASER CUTTING

BACKGROUND

Hydrocarbon resources are typically located below the earth's surface in subterranean porous rock formations, often called reservoirs. These hydrocarbon-bearing reservoirs can be found in depths of tens of thousands of feet below the surface. In order to extract the hydrocarbon fluids, also referred to as oil and/or gas, wells may be drilled to gain access to the reservoirs. Wells may be drilled vertically from the surface, deviated from vertical, or vertical to horizontal in order to most effectively access the subsurface hydrocarbon reservoirs.

A step in the drilling operations, or well construction, involves casing the wellbore with tubulars and cementing the tubulars in place. This isolates the internal conduit or well from the surrounding formations that may be prone to collapse or have undesirable hazards present such as shallow gas. Each section of the well is typically drilled with a drill bit that is attached to a length of drill string that extends from the bottom of the wellbore to a drilling rig at surface. Upon completion of drilling a section of well bore, the drill string and the drill bit are pulled out of the wellbore and a section of casing is deployed and cemented into place to create the desired isolation from the newly drilled formation.

In well construction it is often necessary to alter an existing wellbore trajectory. This is typically known as "sidetracking". Scenarios that may require sidetracking include, but are not limited to, a need to avoid subsurface hazards (faults, shallow gas, etc.), planned multi-lateral wells, failure of an existing wellbore, missed geological targets, and reuse of an existing wellbore that has depleted reservoir production. A whipstock is a device that is commonly deployed to facilitate the altering of a wellbore trajectory. The whipstock has a longitudinal tubular body with an inclined plane that when deployed into the wellbore can serve as a deflection surface or ramp to alter the trajectory of the drill bit and, thus, the wellbore.

Conventionally, sidetracking involves a complex series of steps. Normally, a whipstock is deployed and set at a predetermined "casing window" or "side-track" depth inside the wellbore, and within a casing section. A window is typically milled in the casing, following the setting of the whipstock. Typically, at least two mills are required for ensuring that a window can be fully cut and the resultant edges smoothed. A well cleanout assembly is then run to retrieve metal cuttings, and finally the whipstock needs to be retrieved after the task of actually drilling a lateral is complete.

Conventional operations as noted can clearly be time-consuming and expensive, especially in connection with certain rig locations. On the other hand, operational difficulties can often be encountered such as mechanical problems with the mills, human error in the course of shaping the window, and problems with setting and retrieving the whipstocks.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a method including deploying a bottom hole assembly downhole into a wellbore lined with a casing. While the bottom hole assembly is deployed downhole, the bottom hole assembly is used to: place a guiding profile within the wellbore casing, wherein the guiding profile is structured to physically guide a downhole drill in a direction different from that of a longitudinal axis of the casing; cut a window in the casing with a laser cutter; and withdraw at least one cut portion of the casing away from the window.

In one aspect, embodiments disclosed herein relate to a bottom hole assembly including: a laser cutter for cutting a window in a wellbore casing; a withdrawal mechanism for withdrawing at least one cut portion of the casing away from the cut window; and a releasable guiding profile structured to physically guide a downhole drill in a direction away from the wellbore casing.

In one aspect, embodiments disclosed herein relate to a method including: appending a guiding profile to a bottom hole assembly; and thereafter deploying the bottom hole assembly downhole into a wellbore lined with a casing. While the bottom hole assembly is deployed downhole, the bottom hole assembly is used to: attach the guiding profile to the wellbore casing, wherein the guiding profile is structured to physically guide a downhole drill in a direction different from that of a longitudinal axis of the casing; withdraw the bottom hole assembly away from the guiding profile; thereafter cut a window in the casing with a laser tool; and withdraw at least one cut portion of the casing away from the window.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Broadly contemplated herein, in accordance with one or more embodiments, are methods and systems for optimizing and enhancing sidetracking operations via the use of a laser cutter instead of mechanical cutting tools (such as mills) to create a casing window for facilitating subsequent lateral (or non-vertical) drilling. More particularly, such methods and systems permit running in hole, and setting an enhanced guiding profile—analogous to a whipstock—in the same downhole run as cutting a window and retrieving its physical remnants.

Figure 1:
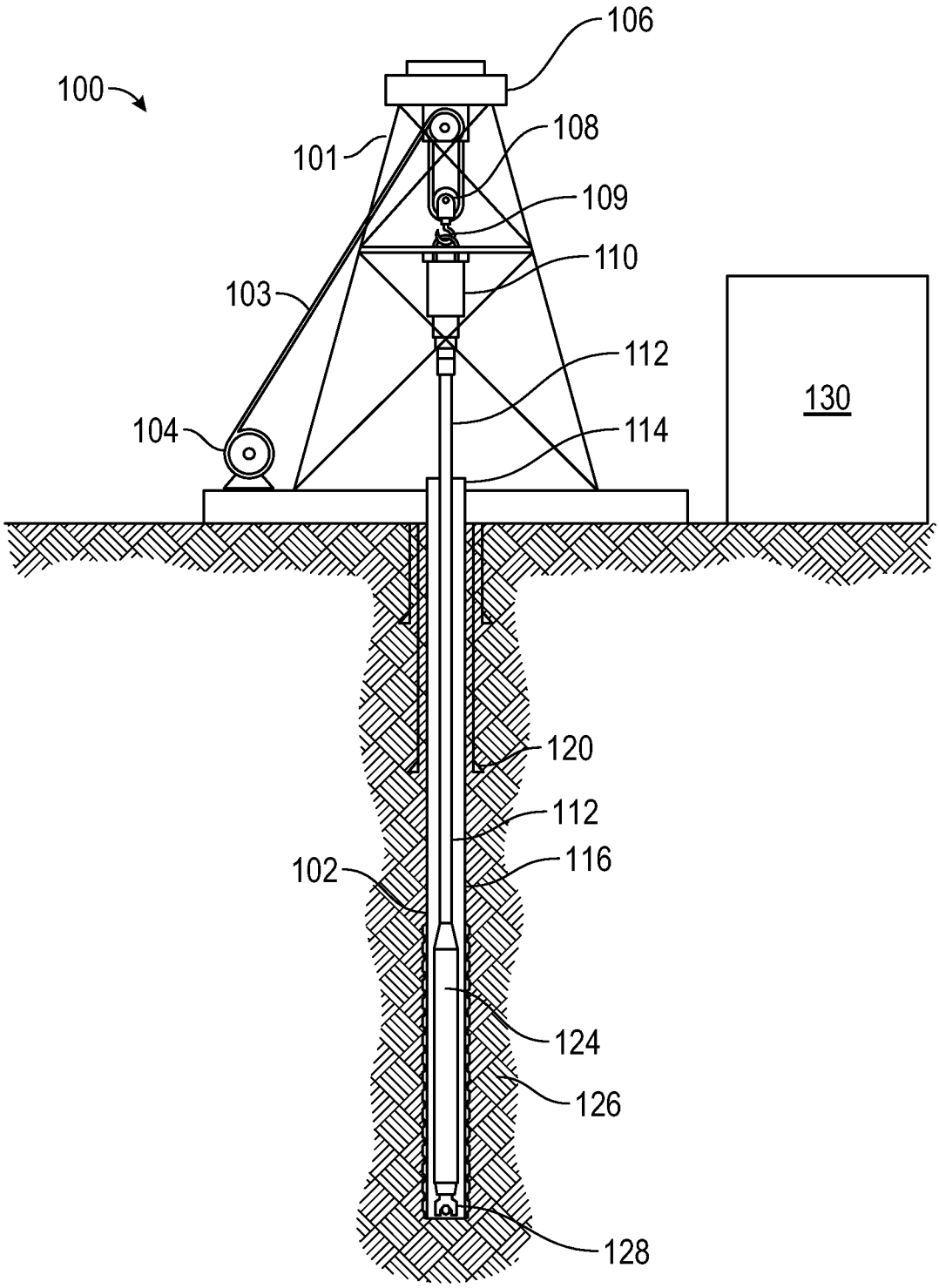
FIG. 1 schematically illustrates, in a cross-sectional elevational view, a conventional drilling rig and wellbore by way of general background and in accordance with one or more embodiments.

FIG. 1 schematically illustrates, in a cross-sectional elevational view, a conventional drilling rig and wellbore by way of general background and in accordance with one or more embodiments. As such, FIG. 1 illustrates a non-restrictive example of a well site 100. The well site 100 is depicted as being on land. In other examples, the well site 100 may be offshore, and drilling may be carried out with or without use of a marine riser. A drilling operation at well site 100 may include drilling a wellbore 102 into a subsurface including various formations 126. For the purpose of drilling a new section of wellbore 102, a drill string 112 is suspended within the wellbore 102. The drill string 112 may include one or more drill pipes connected to form conduit and a bottom hole assembly (BHA) 124 disposed at the distal end of the conduit. The BHA 124 may include a drill bit 128 to cut into the subsurface rock. The BHA 124 may include measurement tools, such as a measurement-while-drilling (MWD) tool or a logging-while-drilling (LWD) tool (not shown), as well as other drilling tools that are not specifically shown but would be understood to a person skilled in the art.

Additionally, by way of general background in accordance with one or more embodiments, the drill string 112 may be suspended in wellbore 102 by a derrick structure 101. A crown block 106 may be mounted at the top of the derrick structure 101. A traveling block 108 may hang down from the crown block 106 by means of a cable or drill line 103. One end of the drill line 103 may be connected to a drawworks 104, which is a reeling device that can be used to adjust the length of the drill line 103 so that the traveling block 108 may move up or down the derrick structure 101. The traveling block 108 may include a hook 109 on which a top drive 110 is supported. The top drive 110 is coupled to the top of the drill string 112 and is operable to rotate the drill string 112. Alternatively, the drill string 112 may be rotated by means of a rotary table (not shown) on the surface 114. Drilling fluid (commonly called mud) may be pumped from a mud system 130 into the drill string 112. The mud may flow into the drill string 112 through appropriate flow paths in the top drive 110 or through a rotary swivel if a rotary table is used (not shown).

Further, by way of general background in accordance with one or more embodiments, and during a drilling operation at the well site 100, the drill string 112 is rotated relative to the wellbore 102 and weight is applied to the drill bit 128 to enable the drill bit 128 to break rock as the drill string 112 is rotated. In some cases, the drill bit 128 may be rotated independently with a drilling motor (not shown). In other embodiments, the drill bit 128 may be rotated using a combination of a drilling motor (not shown) and the top drive 110 (or a rotary swivel if a rotary table is used instead of a top drive) to rotate the drill string 112. While cutting rock with the drill bit 128, mud (not shown) is pumped into the drill string 112. The mud flows down the drill string 112 and exits into the bottom of the wellbore 102 through nozzles in the drill bit 128. The mud in the wellbore 102 then flows back up to the surface 114 in an annular space between the drill string 112 and the wellbore 102 carrying entrained cuttings to the surface 114. The mud with the cuttings is returned to the mud system 130 to be circulated back again into the drill string 112. Typically, the cuttings are removed from the mud, and the mud is reconditioned as necessary, before pumping the mud again into the drill string 112.

Moreover, by way of general background in accordance with one or more embodiments, drilling operations are completed upon the retrieval of the drill string 112, the BHA 124, and the drill bit 128 from the wellbore 102. In some embodiments of wellbore 102 construction, production casing operations may commence. A casing string 116, which is made up of one or more larger diameter tubulars that have a larger inner diameter than the drill string 112 but a smaller outer diameter than the wellbore 102, is lowered into the wellbore 102 on the drill string 112. Generally, the casing string 116 is designed to isolate the internal diameter of the wellbore 102 from the adjacent formation 126. Once the casing string 116 is in position, it is set and cement is typically pumped down through the internal space of the casing string 116, out of the bottom of the casing shoe 120, and into the annular space between the wellbore 102 and the outer diameter of the casing string 116. This secures the casing string 116 in place and creates the desired isolation between the wellbore 102 and the formation 126. At this point, drilling of the next section of the wellbore 102 may commence.

Conventionally, a whipstock may be deployed when there is a need to alter the trajectory of the wellbore, such as for a sidetracking operation (e.g., to drill a lateral or non-vertical wellbore). Upon reaching a predetermined setting depth, an anchoring mechanism is typically activated and attaches the whipstock to the inside surface of the wellbore casing. Then, in a subsequent operation to mill out a casing window, the deflection surface of the whipstock is used as a ramp to deflect the drill bit away from the existing (e.g., vertical) wellbore so as to commence drilling of a new wellbore with a new (e.g., lateral or non-vertical) trajectory.

Figure 2:
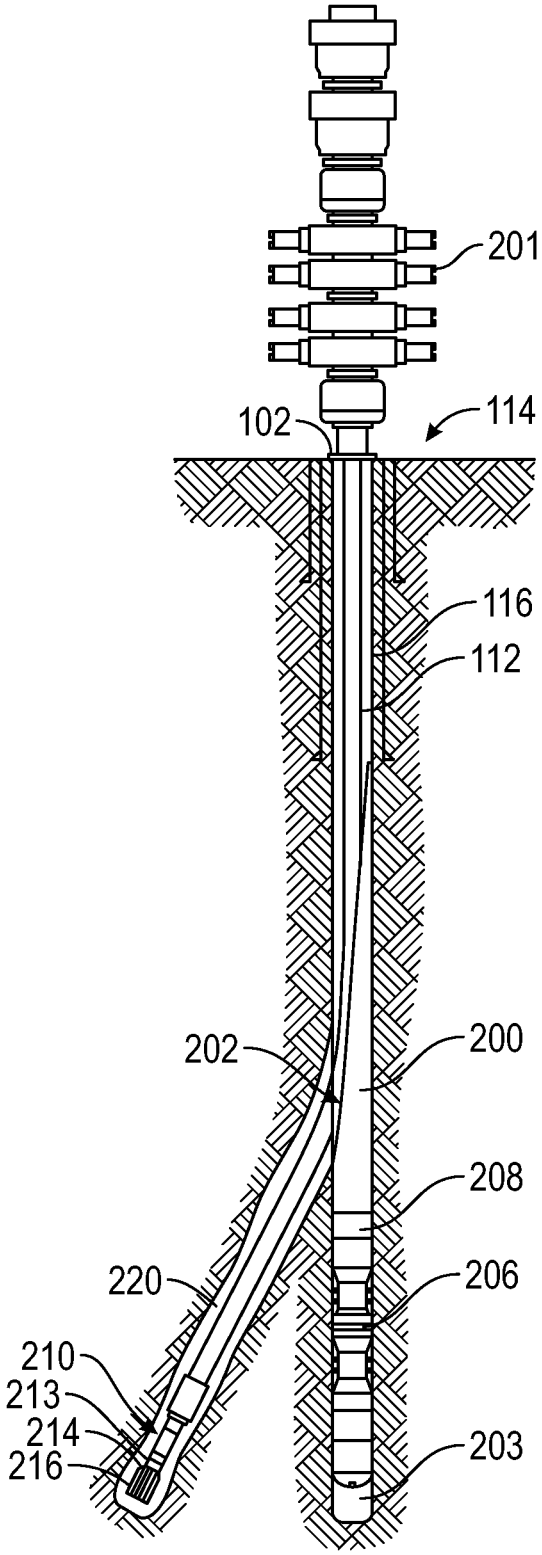
FIG. 2 schematically illustrates, in a cross-sectional elevational view, a conventional sidetracking operation in the setting of FIG. 1, by way of general background and in accordance with one or more embodiments.

As such, FIG. 2 schematically illustrates, in a cross-sectional elevational view, a conventional sidetracking operation in the setting of FIG. 1, by way of general background and in accordance with one or more embodiments. Shown in FIG. 2 is a whipstock 200 that has been deployed and anchored to the casing string 116 of the mainbore 203 in a wellbore 102, which itself has a Blowout Preventer (BOP) 201 installed. The drilling assembly 210, for milling out a casing window, includes a BHA connection 213, a drilling housing 214 and the mill bit 216.

Additionally, by way of general background and in accordance with one or more embodiments, the whipstock 200 includes a deflection surface 202, and a connection to an anchor 206 via an anchor connection 208. The mill bit 216 of drilling assembly 210 may be a fixed-style bit that is designed for milling through metal or steel, especially as configured for milling a window in the casing string 116 when there is a need to "sidetrack" or change the trajectory of a wellbore 102. Thus, FIG. 2 shows that, upon being redirected by the deflection surface 202 of the whipstock 200, the mill bit 216 has milled a window in the casing string 116 and has departed the mainbore 203 and re-oriented the trajectory of the wellbore 102 into a lateral 220. It should also be understood that, for a conventional operation such as that shown in FIG. 2, a second milling operation with a different mill bit is very often undertaken to smooth the edges of a milled-out casing window.

The disclosure now turns to working examples of a mechanical coupling in accordance with one or more embodiments, as described and illustrated with respect to FIGS. 3-6. It should be understood and appreciated that these merely represent illustrative examples, and that a great variety of possible implementations are conceivable within the scope of embodiments as broadly contemplated herein.

Figure 3:
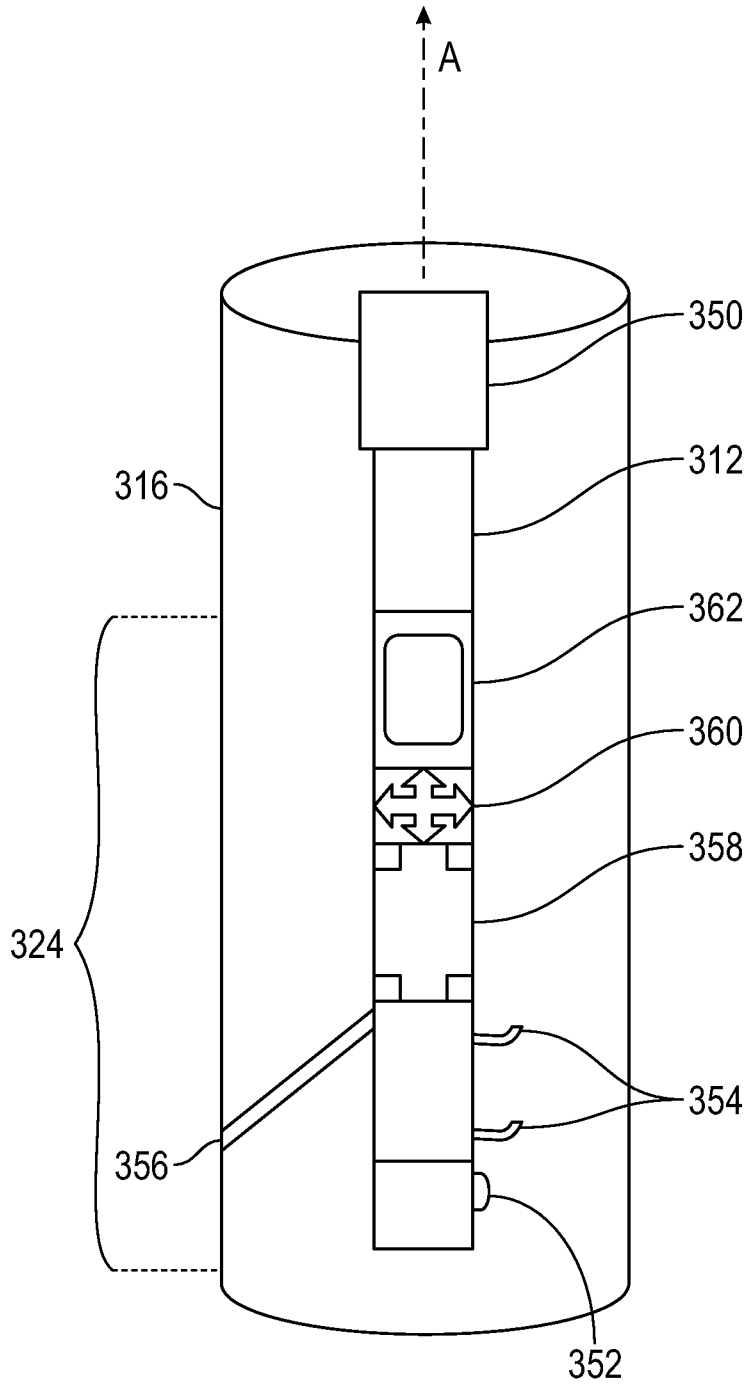
FIG. 3 schematically illustrates, in elevational view, a bottom hole assembly deployed within a wellbore casing, in accordance with one or more embodiments.

FIG. 3 schematically illustrates a bottom hole assembly deployed within a wellbore casing, in accordance with one or more embodiments. As shown, the casing 316 defines a central longitudinal axis A which may be generally vertical in orientation. In accordance with one or more embodiments, and as shown in FIG. 3, a drill string 312 deployed within a casing 316 may include a BHA 324 appended to a lower, distal end thereof; for instance, it may be appended to a lowermost section of drill pipe in the string 312 which includes a collar 350 at an upper end of that section. As such, the BHA 324 may include (progressing upwardly from a lower end in the figure) a pre-programmed laser cutter 352, latching hooks 354 for retrieving the material cut for the casing window, and a side arm 356 to assist in physical stabilization during such retrieval. Also included are a power source 358 for the laser cutter 352, a mud pulse telemetry system 360 and, toward the top of the BHA 324, a sidewise jar 362.

As such, in accordance with one or more embodiments, the BHA 324 is deployed to a predetermined depth within the casing 316 (and associated wellbore). The laser cutter 352 begins an operation for cutting a window in the casing 316, guided by decoded mud pulse data sent from the surface to telemetry system 360. (The cutting of a window may occur before or after a guiding profile is set in place, as discussed further below.) A window is thus cut in the casing 316 to predetermined dimensions. Thus, by way of example, an outline of the window may generally be rectilinear, circular or elliptical in shape when viewed in a two-dimensional projection of its shape. The power source 358 can be pre-programmed (e.g., via suitable internal logic) to circulate power to the laser cutter 352 in a manner to prevent overheating.

In accordance with one or more embodiments, as can generally be appreciated, the laser cutter 352 is capable of performing its cutting operation even with fluid intervening in its path. Once the window cutting operation is complete, the latching hooks 354 are appended to the cut window (in casing 316) in preparation for retrieving the cut window piece. The sidewise jar 362 is then activated to create an impact force at or near the position of the cut window in order to break the cement behind the casing 316, such that the cut window piece is sufficiently loosened to be withdrawn away from the window opening.

As such, in accordance with one or more embodiments, a guiding profile—which functions analogously to a whipstock—may also be appended or attached to a lowermost portion of BHA 324 (e.g., just below the laser cutter 352). Accordingly, FIG. 4 illustrates a working example of such a guiding profile 460, structured to physically guide a downhole drill in a direction different from that of the longitudinal axis of the casing (e.g., axis A shown in FIG. 3).

Figure 4:
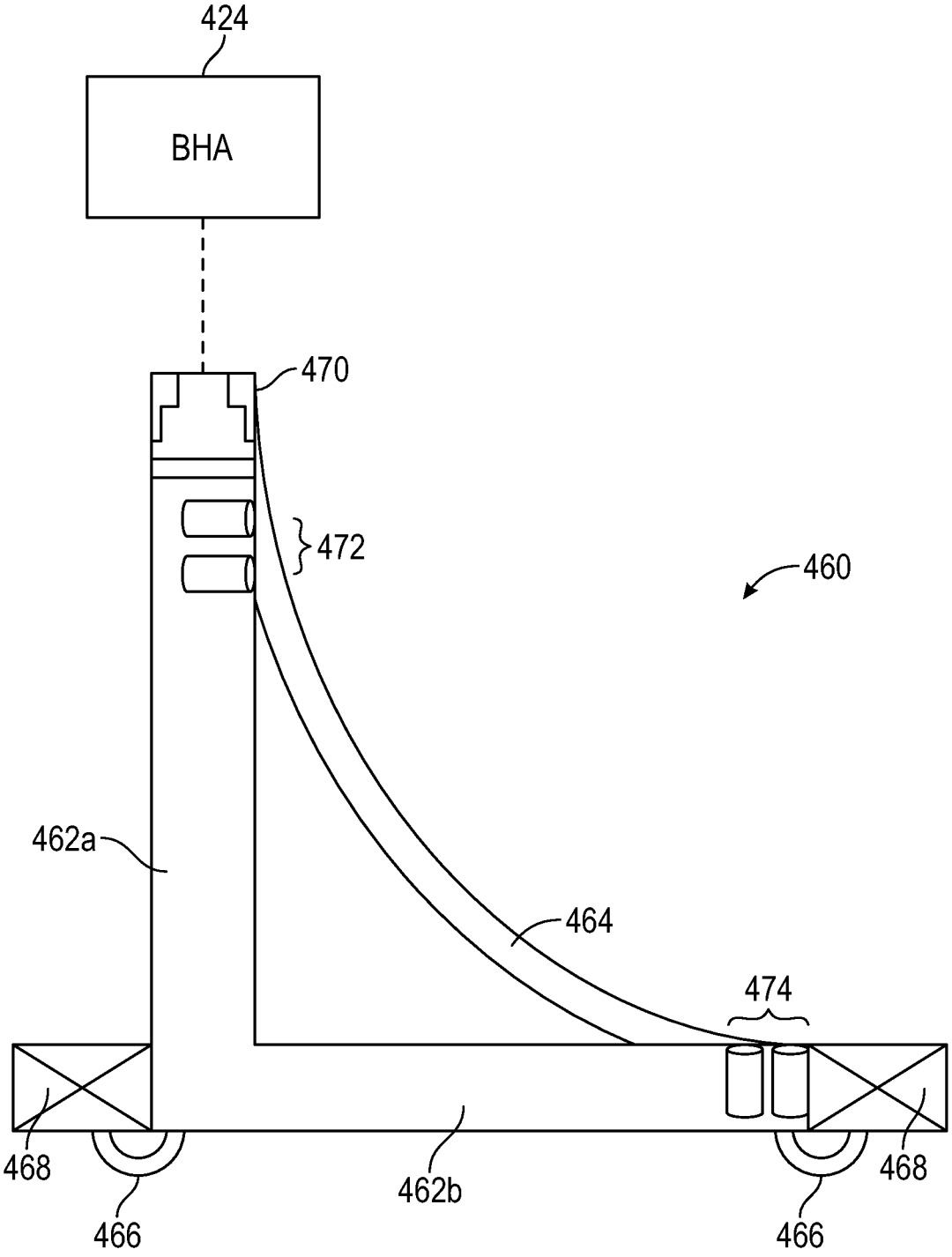
FIG. 4 schematically illustrates, in elevational view, a guiding profile in accordance with one or more embodiments.

As shown in FIG. 4, in accordance with one or more embodiments, guiding profile 460 (releasable from a BHA 424) may include a support frame with vertical and horizontal portions 462*a* and 462*b*, respectively, combining to form an "L" shape when viewed transversely as shown. Extending (and supported) between the vertical frame portion 462*a* and horizontal frame portion 462*b* is a ramp portion 464; alternatively the ramp portion may be termed a "deflection surface". As shown, ramp portion 464 may be curved (e.g., in the shape of a circular or parabolic arc when viewed transversely as shown) but in accordance with at least one variant example it may take the form of a straight ramp component (and, e.g., be oriented at a predetermined slope with respect to the frame portions 462*a/b*). Generally, ramp portion 464 can be understood as the component of guiding profile 460 which physically guides a downhole drill in a direction different from that of the longitudinal axis of the casing (A) shown in FIG. 3.

In accordance with one or more embodiments, to attach the guiding profile 460 to the casing, releasable latching hooks 466 are provided at an underside of horizontal frame portion 462*b*; here, two are shown. Hooks 466 can be released (e.g., via pressure pulses) when the BHA 424 (to which the guiding profile 460 is attached) reaches a predetermined depth within the wellbore, to then attach to the casing to help hold the guiding profile 460 in place. After the hooks 466 are latched into the casing, the BHA 424 can deploy upwardly and thus be withdrawn away from the guiding profile 460, and packers 468 can be set to secure the position of the guiding profile 460 within the casing even more firmly, bridging between the guiding profile 460 and the casing. The packers 468, for their part, may be pull-to-release inflatable packers which are set by being inflated.

In accordance with one or more embodiments, in order to retrieve the guiding profile 460 to return the same to the surface, the guiding profile 460 may be equipped with one or more retrieval portions. As such, guiding profile 460 may include a primary retrieval portion 470 and two backup mechanisms in the form of additional retrieval portions (472, 474) to ensure that the profile 460 can reliably be retrieved after lateral drilling (or sidetracking) is completed. These first, second and third retrieval portions (470, 472, 474), which may also be termed "latching profiles", are separately disposed on different portions of the support frame 462*a/b*, spaced apart from one another. As such, once lateral drilling operations are completed, an incoming retrieval element (or tool), deployed downhole into the wellbore from the surface, may be latched to the primary retrieval portion 470. Thus primary retrieval portion 470 receives the retrieval element to permit withdrawal of the guiding profile 460 from the wellbore and to assist in deflation of the packers 468. In other words, as the guiding profile 460 is withdrawn from the wellbore by being pulled upwardly, this causes the pull-to-release packers 468 to deflate.

In accordance with one or more embodiments, if there is any difficulty with the retrieval element latching onto the primary retrieval portion 470, the secondary retrieval portion 472—provided on the vertical frame portion 462*a* as shown—will also permit the retrieval element to latch to permit withdrawal of the guiding profile 460 from the wellbore and to assist in deflation of the packers 468. In other words, as the guiding profile 460 is withdrawn from the wellbore by being pulled upwardly via secondary retrieval portion 472, the pull-to-release packers 468 will be caused to deflate.

Moreover, in accordance with one or more embodiments, if there is any difficulty in latching onto the secondary retrieval portion 472, the tertiary retrieval portion 474—provided on the horizontal frame portion 462*b* as shown—will permit the retrieval element to latch to permit withdrawal of the guiding profile 460 from the wellbore and to assist in deflation of the packers 468. In one possible arrangement, the retrieval element can be deployed downhole to latch onto both of the secondary 472 and tertiary 474 retrieval portions, pulls the guiding profile 460 upwardly, and thereby creates an equal force at different ends of the frame 462*a/b* to promote deflation of the packers 468.

In accordance with one or more embodiments, FIGS. 5A-5D illustrate various steps in a working example of a process of setting a guiding profile and cutting and retrieving a casing window in one downhole run, using the BHA 324 of FIG. 3 and the guiding profile 460 of FIG. 4. Reference may continue to be made to all of FIGS. 3-5D simultaneously.

Figure 5A:
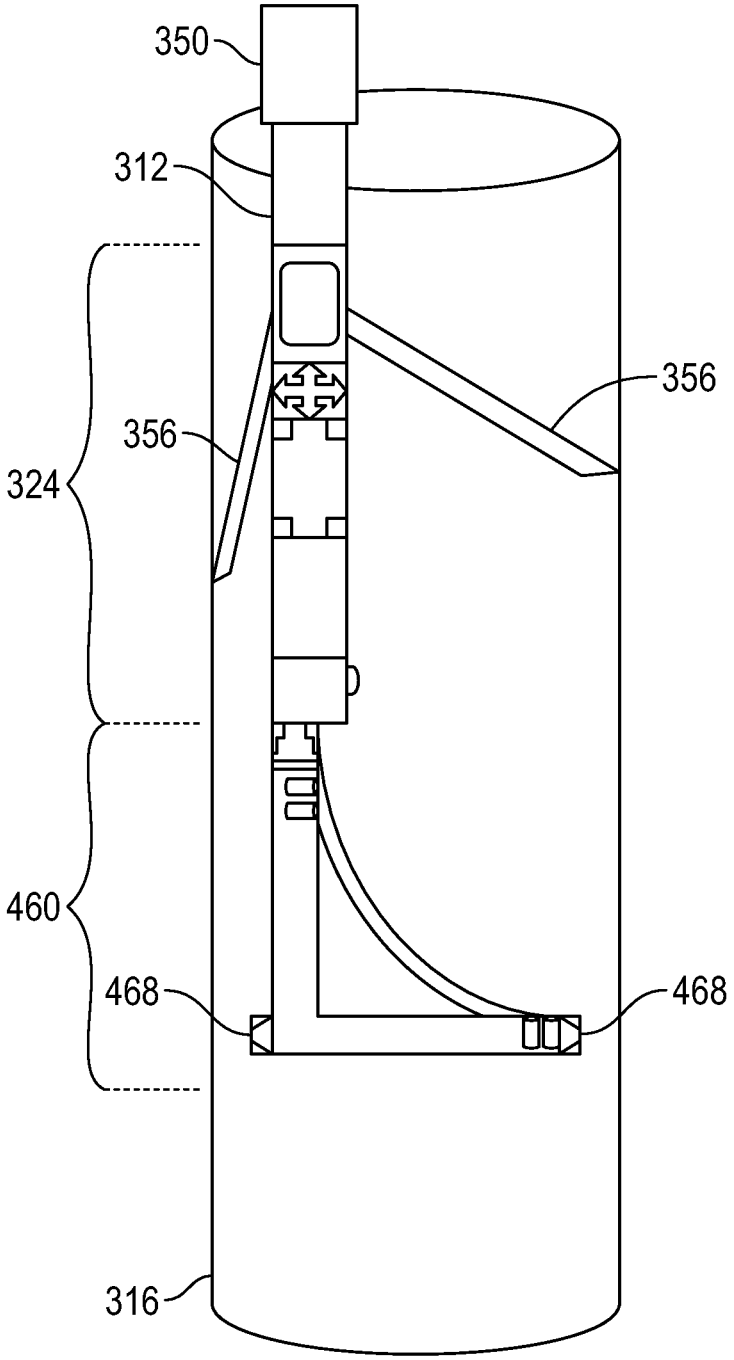
FIGS. 5A-5D illustrate various steps in a working example of a process of setting a guiding profile and cutting and retrieving a casing window in one downhole run, using the bottom hole assembly of FIG. 3 and the guiding profile of FIG. 4, in accordance with one or more embodiments.

As shown in FIG. 5A, in accordance with one or more embodiments, BHA 324 is deployed downhole with guiding profile 460 attached at the far distal end thereof. As shown, the BHA 324 may include two side arms 356 that pivot outwardly from the BHA 324. Thus, once at or near a predetermined depth where a window is to be cut in casing 316, side arms 356 may be deployed to assist in centralizing the BHA 324 and guiding profile 460 within the casing 316. At this initial stage, the packers 468 of guiding profile 460 are deflated.

Figure 5B:
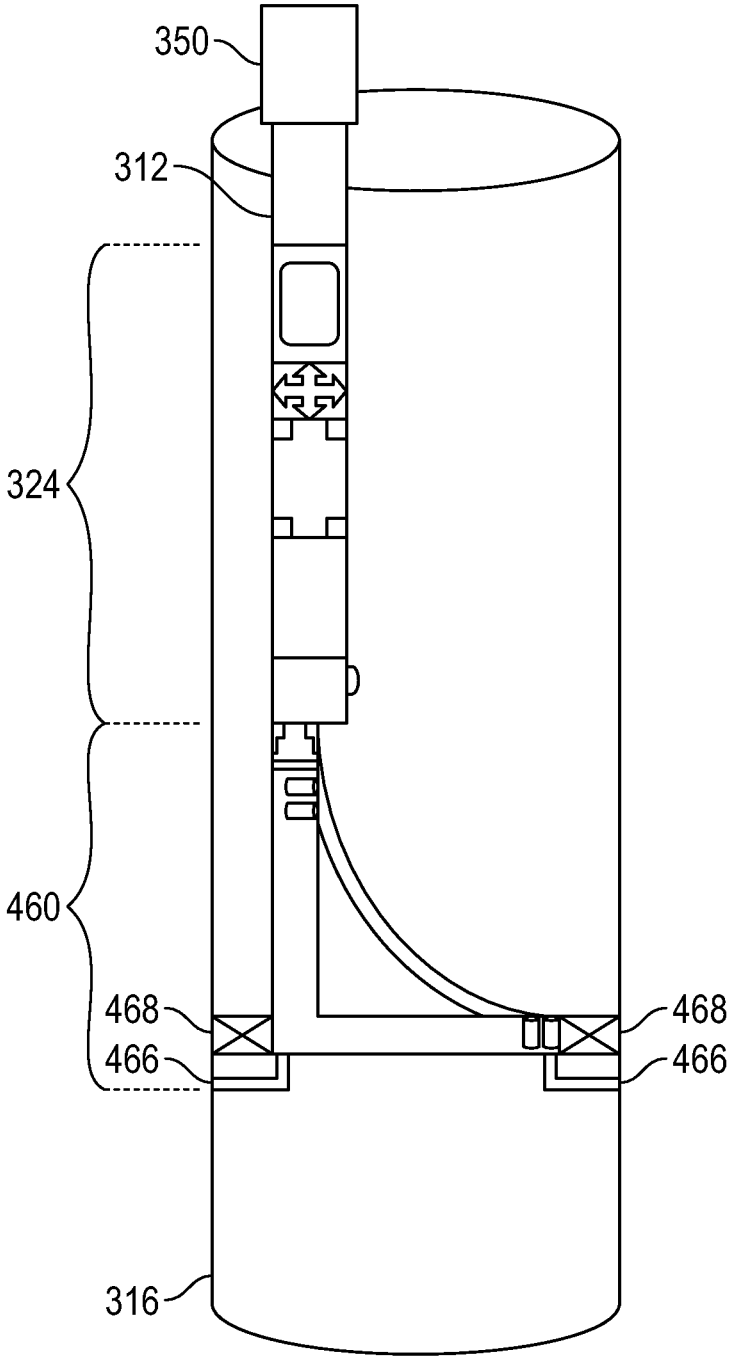

As shown in FIG. 5B, in accordance with one or more embodiments, once at the predetermined depth, latching hooks 466 in the guiding profile 460 are deployed via pressure pulses to latch into the inner wall of casing 316 and thus help hold the guiding profile 460 in place with respect to the casing 316. Packers 468 then will be inflated, also via pressure pulses, to provide further support for the guiding profile 460 and to isolate the wellbore below the guiding profile 460. The side arms (356 in FIG. 5A) are retracted into BHA 324, and a slack-off test can be performed to ensure the packers 468 are set properly.

Figure 5C:
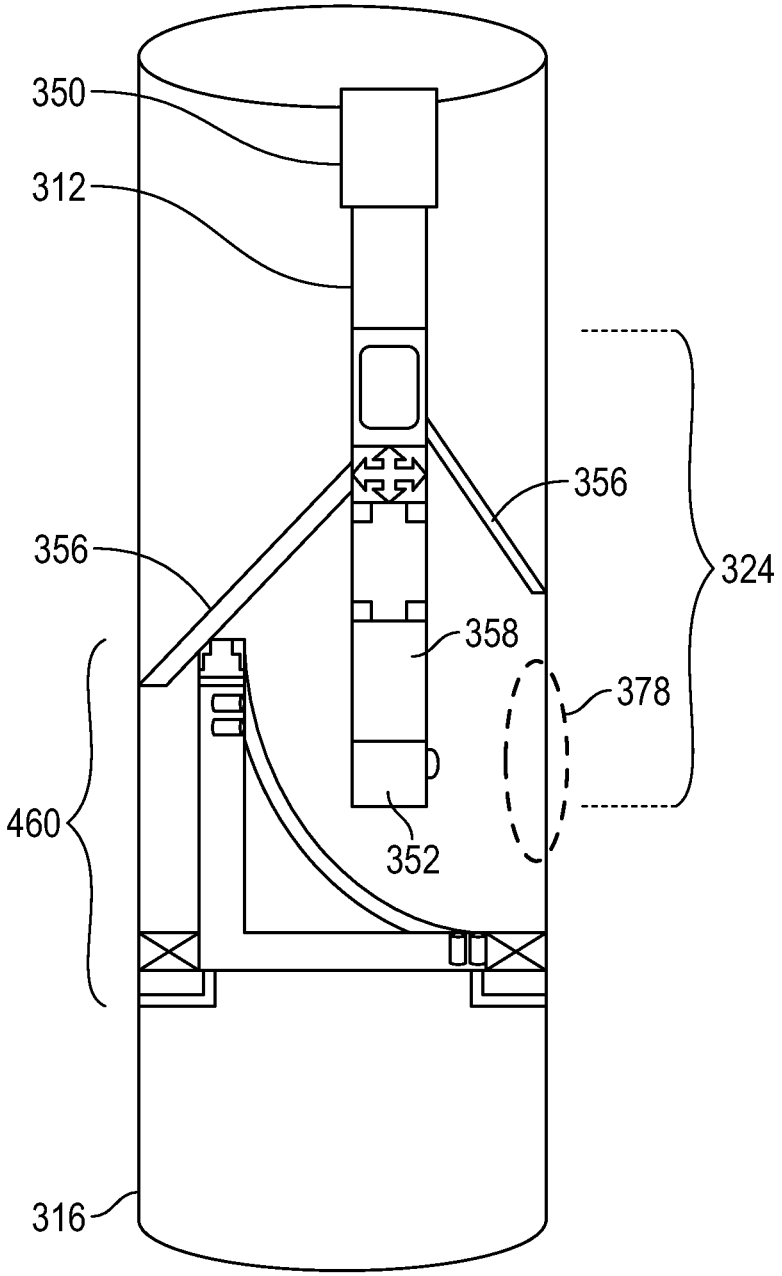

As shown in FIG. 5C, in accordance with one or more embodiments, the BHA 324 may then be physically separated from the guiding profile 460, to cut the window in casing 316. In FIG. 5C, a location for the window is indicated via the dotted circle at 378. Accordingly, BHA 324 may first be displaced axially away from the guiding profile 460; pressure pulses from the surface may be used to effect this separation (e.g., to retract one or more key profiles interconnecting the BHA 324 and guiding profile 460). With the assistance of side arms 356, BHA 324 may then be repositioned as shown to permit laser cutter 352 to begin cutting the window. As noted previously, the laser cutter 352 may be activated via pressure pulses, and the cutting operation itself may then proceed with no manual interaction while power is circulated (via power source 358) to prevent overheating.

Figure 5D:
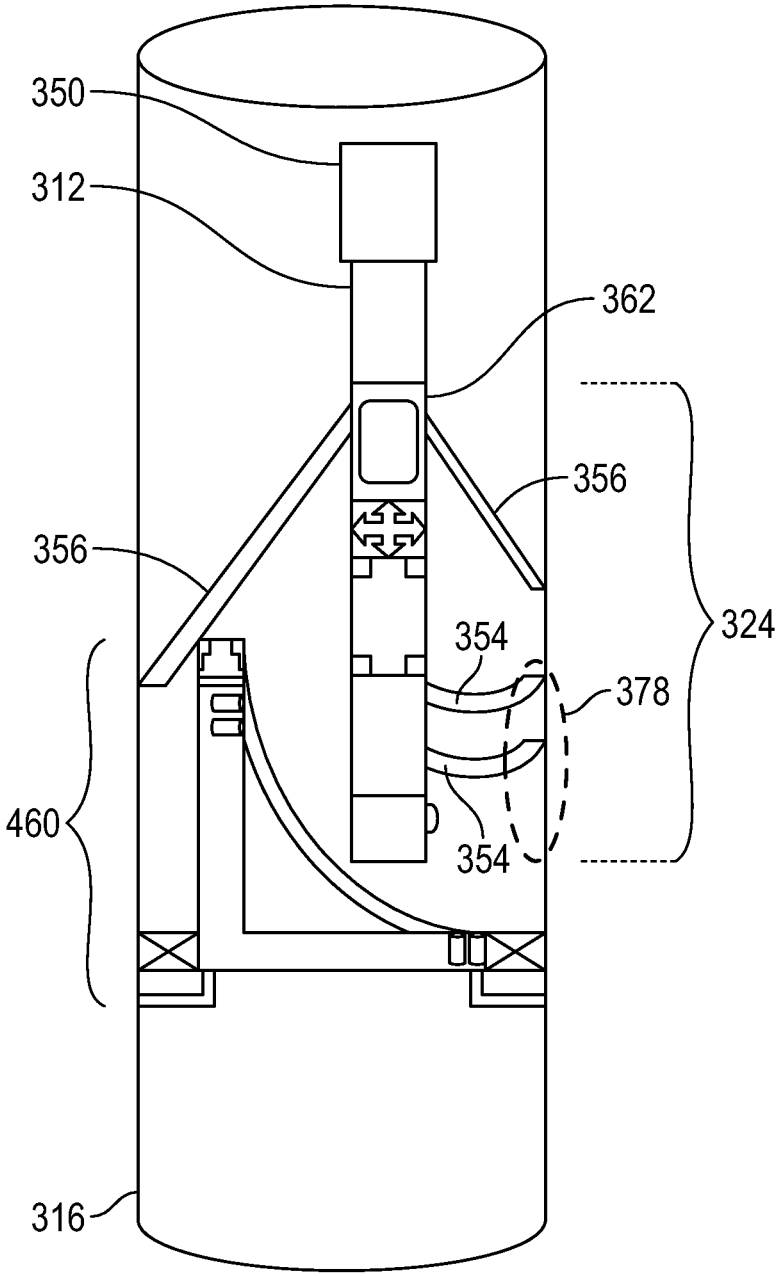

As shown in FIG. 5D, in accordance with one or more embodiments, once the cutting operation is complete, latching hooks 354 are deployed to drill into the cut window (at location 378) via any suitable arrangement, such as a small drill system powered by power source 358. As noted previously, sidewise jar 362 may then be activated (e.g., via pressure pulses) to break cement behind the casing 316 (at or near the cut window at 378), and the BHA 324 may then be pulled up to the surface along with the cut window, while utilizing the side arms 356 for centralization and stabilization during such movement.

In accordance with one or more embodiments, as discussed previously in connection with FIG. 4, after lateral drilling has concluded, the guiding profile 460 may be retrieved. A BHA similar to the BHA 324 shown and described herein may actually be used as a tool for such retrieval (e.g., to latch into one or more latching profiles 470/472/474 as shown in FIG. 4), or another suitable tool may be used.

Figure 6:
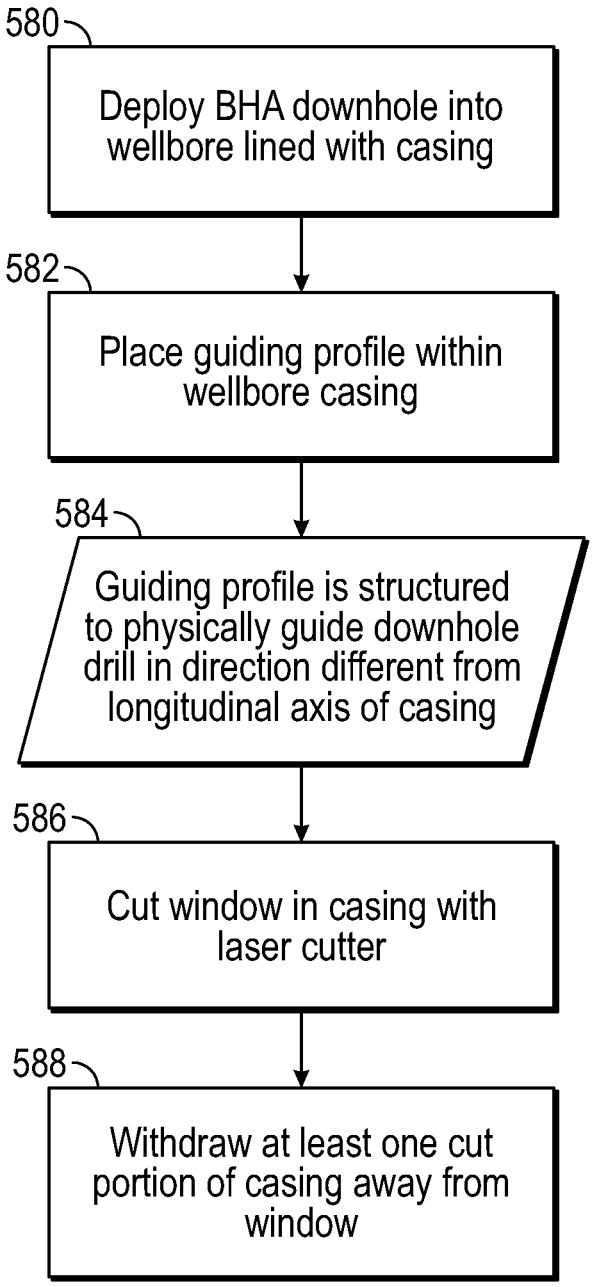
FIG. 6 shows a flowchart of a method in accordance with one or more embodiments.

FIG. 6 shows a flowchart of a method, as a general overview of steps which may be carried out in accordance with one or more embodiments described or contemplated herein.

As such, in accordance with one or more embodiments, a BHA may be deployed downhole into a wellbore lined with a casing (580). By way of illustrative example, the casing may correspond to that indicated at 316 in FIG. 3. While the BHA is deployed downhole, the BHA may be used to place a place a guiding profile within the wellbore casing (582), wherein the guiding profile is structured to physically guide a downhole drill in a direction different from that of a longitudinal axis of the casing (584). By way of illustrative example, the guiding profile may correspond to that indicated at 460 in FIG. 4, and it may be placed with the casing in a manner as discussed with respect to FIG. 4. The BHA may also be used to cut a window in the casing with a laser cutter (586); by way of illustrative example, the laser cutter may correspond to that indicated at 352 in FIG. 3. Additionally, the BHA may be used to withdraw at least one cut portion of the casing away from the window (588). By way of illustrative example, this may be carried out as described herein with respect to FIG. 3, via use of the latching hooks 354.

It can be appreciated from the foregoing that, in accordance with one or more embodiments, a retrievable guiding profile for a sidetracking operation may be set in the same downhole operation, using the same BHA, as cutting a corresponding window in the wellbore casing and retrieving its remnants. Generally, this helps resolve many problems encountered in conventional sidetracking, such as milling inefficiency (e.g., as may arise from extended milling duration), difficulties in establishing a desired window size and smoothness, and difficulties with whipstock retrieval. As broadly contemplated herein, a pre-programmed laser cutter can cut a casing window precisely even through ambient fluid. This process can be undertaken in a shorter time than in conventional operations while mitigating any potential impact of human error. Further, the need for an additional smoothing operation is eliminated along with any need for collecting excess metal cuttings or chips.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method comprising:

deploying a bottom hole assembly downhole into a wellbore lined with a casing; and while the bottom hole assembly is deployed downhole, using the bottom hole assembly to:

place a guiding profile within the wellbore casing, wherein the guiding profile is structured to physically guide a downhole drill in a direction different from that of a longitudinal axis of the casing;

cut a window in the casing with a laser cutter, to form at least one cut portion of the casing;

appending at least one latching hook to the at least one cut portion of the casing; and using the at least one latching hook to withdraw the at least one cut portion of the casing away from the window.

2. The method according to claim 1, further comprising appending the guiding profile to the bottom hole assembly before the bottom hole assembly is deployed downhole.

3. The method according to claim 1, wherein placing the guiding profile comprises attaching the guiding profile to the casing and withdrawing the bottom hole assembly away from the guiding profile.

4. The method according to claim 3, wherein attaching the guiding profile comprises applying one or more pressure pulses to release one or more hooks to attach to the casing.

5. The method according to claim 1, further comprising retrieving the guiding profile and returning the guiding profile to a surface.

6. The method according to claim 1, wherein placing the guiding profile comprises setting at least one packer to bridge between the guiding profile and the casing.

7. The method according to claim 6, wherein the at least one packer comprises at least one inflatable packer, and setting the at least packer comprises inflating the at least one packer.

8. The method according to claim 7, wherein the guiding profile comprises a first retrieval portion which receives a retrieval element to withdraw the guiding profile from the wellbore and assists to deflate the at least one inflatable packer.

9. The method according to claim 8, wherein:

the guiding profile comprises a support frame and a ramp portion;

the ramp portion is supported by the support frame and physically guides the downhole drill in a direction different from that of the longitudinal axis of the casing;

the first retrieval portion is disposed on the support frame; and the guiding profile comprises a second retrieval portion which receives the retrieval element to withdraw the guiding profile from the wellbore and assists to deflate the at least one inflatable packer;

the second retrieval portion being disposed on the support frame separately from the first retrieval portion.

10. The method according to claim 9, wherein:

the guiding profile comprises a third retrieval portion which receives the retrieval element to withdraw the guiding profile from the wellbore and assists to deflate the at least one inflatable packer;

the third retrieval portion being disposed on the support frame separately from the first and second retrieval portions.

11. The method according to claim 1, wherein the casing is cemented to the wellbore, and withdrawing the least one cut portion of the casing includes applying an impact force to the casing and breaking the cement adjacent thereto.

12. The method according to claim 11, further comprising a sidewise jar for applying the impact force to the casing and breaking the cement adjacent thereto.

13. A method comprising:

appending a guiding profile to a bottom hole assembly;

thereafter deploying the bottom hole assembly downhole into a wellbore lined with a casing; and while the bottom hole assembly is deployed downhole, using the bottom hole assembly to:

attach the guiding profile to the wellbore casing, wherein the guiding profile is structured to physically guide a downhole drill in a direction different from that of a longitudinal axis of the casing;

withdraw the bottom hole assembly away from the guiding profile;

thereafter cut a window in the casing with a laser tool, to form at least one cut portion of the casing;

append at least one latching hook to the at least one cut portion of the casing; and use the at least one latching hook to withdraw the at least one cut portion of the casing away from the window.

* * * * *